US010865071B2

(12) United States Patent
Roberts et al.

(10) Patent No.: US 10,865,071 B2
(45) Date of Patent: Dec. 15, 2020

(54) CONFIGURABLE MULTICAR ELEVATOR SYSTEM

(71) Applicant: Otis Elevator Company, Farmington, CT (US)

(72) Inventors: Randall Keith Roberts, Hebron, CT (US); Zbigniew Piech, Cheshire, CT (US); Adam Marian Myszkowski, Ostrow Wlkp (PL); Cezary Jedryczka, Lniano (PL); Wojciech Szelag, Poznan (PL); Tadeusz Witczak, Bethel, CT (US); Enrico Manes, Feeding Hills, MA (US); Richard N. Fargo, Plainville, CT (US); Bryan Robert Siewert, Farmington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 408 days.

(21) Appl. No.: 15/537,068

(22) PCT Filed: Dec. 17, 2015

(86) PCT No.: PCT/US2015/066273
§ 371 (c)(1),
(2) Date: Jun. 16, 2017

(87) PCT Pub. No.: WO2016/100609
PCT Pub. Date: Jun. 23, 2016

(65) Prior Publication Data

US 2018/0044138 A1 Feb. 15, 2018

Related U.S. Application Data

(60) Provisional application No. 62/093,100, filed on Dec. 17, 2014.

(51) Int. Cl.
*B66B 9/00* (2006.01)
*B66B 1/24* (2006.01)
(Continued)

(52) U.S. Cl.
CPC ..... *B66B 9/003* (2013.01); *B66B 1/2491* (2013.01); *B66B 1/3446* (2013.01);
(Continued)

(58) Field of Classification Search
CPC ..... B66B 9/003; B66B 1/2491; B66B 1/3449; B66B 1/3446
(Continued)

(56) References Cited

U.S. PATENT DOCUMENTS 2,052,690 A * 9/1936 Austin ..... B66B 7/021 187/249
2,612,238 A * 9/1952 Angelicola ..... B66B 9/10 187/270
(Continued)

FOREIGN PATENT DOCUMENTS

CN 1462718 A 12/2003
CN 101875465 A 11/2010
(Continued)

OTHER PUBLICATIONS

Chinese Office Action for application CN 20150069187.3, dated Nov. 13, 2018, 8 pages.
(Continued)

*Primary Examiner* — David S Warren
(74) *Attorney, Agent, or Firm* — Cantor Colburn LLP

(57) ABSTRACT

A method and system for managing an elevator system (10), includes providing a plurality of elevator cars (14) to travel in a hoistway (11), and selectively introducing and removing
(Continued)

at least one of the plurality of elevator cars (14) to and from the hoistway (11) via a loading station (50).

16 Claims, 6 Drawing Sheets

(51) Int. Cl.
*B66B 1/34* (2006.01)
*B66B 5/00* (2006.01)
*B66B 11/02* (2006.01)
*B66B 11/04* (2006.01)

(52) U.S. Cl.
CPC ..... *B66B 5/0031* (2013.01); *B66B 11/0226* (2013.01); *B66B 11/0407* (2013.01)

(58) Field of Classification Search
USPC ..... 187/247
See application file for complete search history.

(56) References Cited

U.S. PATENT DOCUMENTS 3,486,584 A * 12/1969 Hall ..... B66B 1/18 187/387
4,352,410 A * 10/1982 Bittar ..... B66B 1/468 187/381
5,419,414 A * 5/1995 Sakita ..... B66B 1/2433 187/247
5,857,545 A 1/1999 Barrett et al.
6,955,245 B2 * 10/2005 Dunser ..... B66B 1/2466 187/249
7,621,376 B2 * 11/2009 Duenser ..... B66B 9/00 187/247
7,650,966 B2 * 1/2010 Sansevero ..... B66B 1/2466 187/249
7,686,140 B2 * 3/2010 Rossignol ..... B66B 7/1215 187/393
8,312,970 B2 * 11/2012 Mustalahti ..... B66B 15/02 187/266
8,430,210 B2 * 4/2013 Jacobs ..... B66B 11/0095 187/249
8,434,599 B2 * 5/2013 Wang ..... B66B 5/0031 187/249
8,602,171 B2 * 12/2013 Vogl ..... B66B 5/0087 187/380
9,079,752 B2 * 7/2015 Takeshima ..... B66B 1/2458
9,248,994 B2 * 2/2016 Grundmann ..... B66B 9/00
9,758,347 B2 * 9/2017 Dudde ..... B66B 9/00
10,001,861 B2 * 6/2018 Trottman ..... B66B 11/0246
2003/0217893 A1 * 11/2003 Dunser ..... B66B 1/2466 187/249
2004/0262093 A1 * 12/2004 Forsythe ..... B66B 1/34 187/391
2006/0011420 A1 * 1/2006 Duenser ..... B66B 9/00 187/382
2007/0209881 A1 * 9/2007 Sansevero ..... B66B 1/2466 187/247
2008/0047783 A1 * 2/2008 Vogl ..... B66B 5/0087 187/314
2008/0202863 A1 * 8/2008 Rossignol ..... B66B 7/1215 187/393
2010/0213012 A1 * 8/2010 Wang ..... B66B 5/0031 187/247
2012/0168261 A1 * 7/2012 Takeshima ..... B66B 1/2458 187/385
2012/0217100 A1 * 8/2012 Spirgi ..... B66B 5/0037 187/393
2015/0314991 A1 * 11/2015 Trottman ..... B66B 11/0246 187/393
2016/0107862 A1 * 4/2016 Kattainen ..... B66B 5/0031 187/247
2016/0130112 A1 * 5/2016 Nikovski ..... B66B 1/2458 187/247
2016/0185568 A1 * 6/2016 Kusserow ..... B66B 1/3446 340/3.31
2017/0217724 A1 * 8/2017 Shibata ..... B66B 1/32
2017/0233218 A1 * 8/2017 Zheng ..... B66B 1/2491 187/247
2017/0305718 A1 * 10/2017 Finschi ..... B66B 1/2433
2017/0313545 A1 * 11/2017 Gerstenmeyer ..... B66B 1/2466
2018/0009636 A1 * 1/2018 Jedryczka ..... B66B 9/003
2018/0044138 A1 * 2/2018 Roberts ..... B66B 1/2491
2018/0282110 A1 * 10/2018 Hanninen ..... B66B 1/2466
2019/0135579 A1 * 5/2019 Siikonen ..... B66B 1/28
2019/0168991 A1 * 6/2019 Siikonen ..... B66B 9/003

FOREIGN PATENT DOCUMENTS

DE 2154923 A1 5/1973
EP 2208701 A1 7/2010
JP H04189287 A 7/1992
JP H0539173 A 2/1993
JP 2000063058 A 2/2000
WO 2008136692 A2 11/2008

OTHER PUBLICATIONS

International Search Report and Written Opinion for application PCT/US2015066273, dated Jun. 8, 2016, 18pgs.
Invitation to Pay Additional Fees for application PCT/US2015066273, dated Mar. 29, 2016, 7pgs.

* cited by examiner

CONFIGURABLE MULTICAR ELEVATOR SYSTEM

FIELD OF THE INVENTION

The subject matter disclosed herein relates generally to the field of elevators, and more particularly to a multicar, ropeless elevator system.

DESCRIPTION OF RELATED ART

Ropeless elevator systems, also referred to as self-propelled elevator systems, are useful in certain applications (e.g., high rise buildings) where the mass of the ropes for a roped system is prohibitive, roped elevator core space can become too large, and there is a desire for multiple elevator cars to travel in a single lane. There exist ropeless elevator systems with multiple lanes in which some lanes are designated for upward traveling elevator cars and some lanes are designated for downward traveling elevator cars. Transfer stations at various locations in the hoistway are used to move cars horizontally between these various upward and downward moving lanes.

Ropeless elevator systems are often used for variety of applications and users. Certain applications and users have different objectives, requirements, and desires. Further, elevator cars may need to be evaluated for service and maintenance requirements. A system and method that can selectively introduce and remove elevator cars from a ropeless elevator system is desired to optimize performance and service.

BRIEF SUMMARY

According to an embodiment of the invention, an elevator system includes a plurality of elevator cars to travel in a hoistway, and a loading station to selectively introduce and remove at least one of the plurality of elevator cars to and from the hoistway.

In addition to one or more of the features described above, or as an alternative, further embodiments could include that an elevator car of the plurality of elevator cars is a specialized elevator car.

In addition to one or more of the features described above, or as an alternative, further embodiments could include that the specialized elevator car includes a vending car, a delivery car, a cargo car, a trash car, a private VIP car, a visitor car and a service car.

In addition to one or more of the features described above, or as an alternative, further embodiments could include that the specialized elevator car is assigned a higher priority than a remainder of the plurality of elevator cars.

In addition to one or more of the features described above, or as an alternative, further embodiments could include that an elevator car of the plurality of elevator cars includes an on board evaluation station in the elevator car.

In addition to one or more of the features described above, or as an alternative, further embodiments could include that an elevator car of the plurality of elevator cars includes a wireless link to communicate a car status to the elevator system.

In addition to one or more of the features described above, or as an alternative, further embodiments could include an evaluation station in the hoistway to evaluate at least one of the plurality of elevator cars.

In addition to one or more of the features described above, or as an alternative, further embodiments could include that the evaluation station signals the loading station to remove at least one of the plurality of elevator cars from the hoistway.

In addition to one or more of the features described above, or as an alternative, further embodiments could include that the evaluation station evaluates at least one of the plurality of elevator cars periodically.

In addition to one or more of the features described above, or as an alternative, further embodiments could include that the evaluation station evaluates a respective thrust performance, a respective braking performance, and a respective power performance of at least one of the plurality of elevator cars.

In addition to one or more of the features described above, or as an alternative, further embodiments could include a transportation device to receive and transport a removed elevator car of the plurality of elevator cars.

In addition to one or more of the features described above, or as an alternative, further embodiments could include a transport mechanism to transport and store a removed elevator car of the plurality of elevator cars.

In addition to one or more of the features described above, or as an alternative, further embodiments could include that an elevator car is stored in the hoistway without obstructing a hoistway lane.

In addition to one or more of the features described above, or as an alternative, further embodiments could include a transport mechanism to transport and store a removed elevator car of the plurality of elevator cars.

In addition to one or more of the features described above, or as an alternative, further embodiments could include that a removed elevator car is stored in a last in first out transport mechanism, a first in first out transport mechanism, or a selective transport mechanism.

According to an embodiment of the invention, a method managing an elevator system, includes providing a plurality of elevator cars to travel in a hoistway, and selectively introducing and removing at least one of the plurality of elevator cars to and from the hoistway via a loading station.

In addition to one or more of the features described above, or as an alternative, further embodiments could include that an elevator car of the plurality of elevator cars is a specialized elevator car.

In addition to one or more of the features described above, or as an alternative, further embodiments could include evaluating at least one of the plurality of elevator cars in the hoistway via an evaluation station.

In addition to one or more of the features described above, or as an alternative, further embodiments could include signaling the loading station to remove at least one of the plurality of elevator cars from the hoistway via the evaluation station.

In addition to one or more of the features described above, or as an alternative, further embodiments could include receiving and transporting a removed elevator car of the plurality of elevator cars via a transportation device.

In addition to one or more of the features described above, or as an alternative, further embodiments could include transporting and storing a removed elevator car of the plurality of elevator cars via a transport mechanism.

Technical function of the embodiments described above includes selectively introduce and remove at least one of the plurality of elevator cars to and from the hoistway.

Other aspects, features, and techniques of the invention will become more apparent from the following description taken in conjunction with the drawings.

BRIEF DESCRIPTION OF THE SEVERAL VIEWS OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which like elements are numbered alike in the several FIGURES:

DETAILED DESCRIPTION OF THE INVENTION

Figure 1:
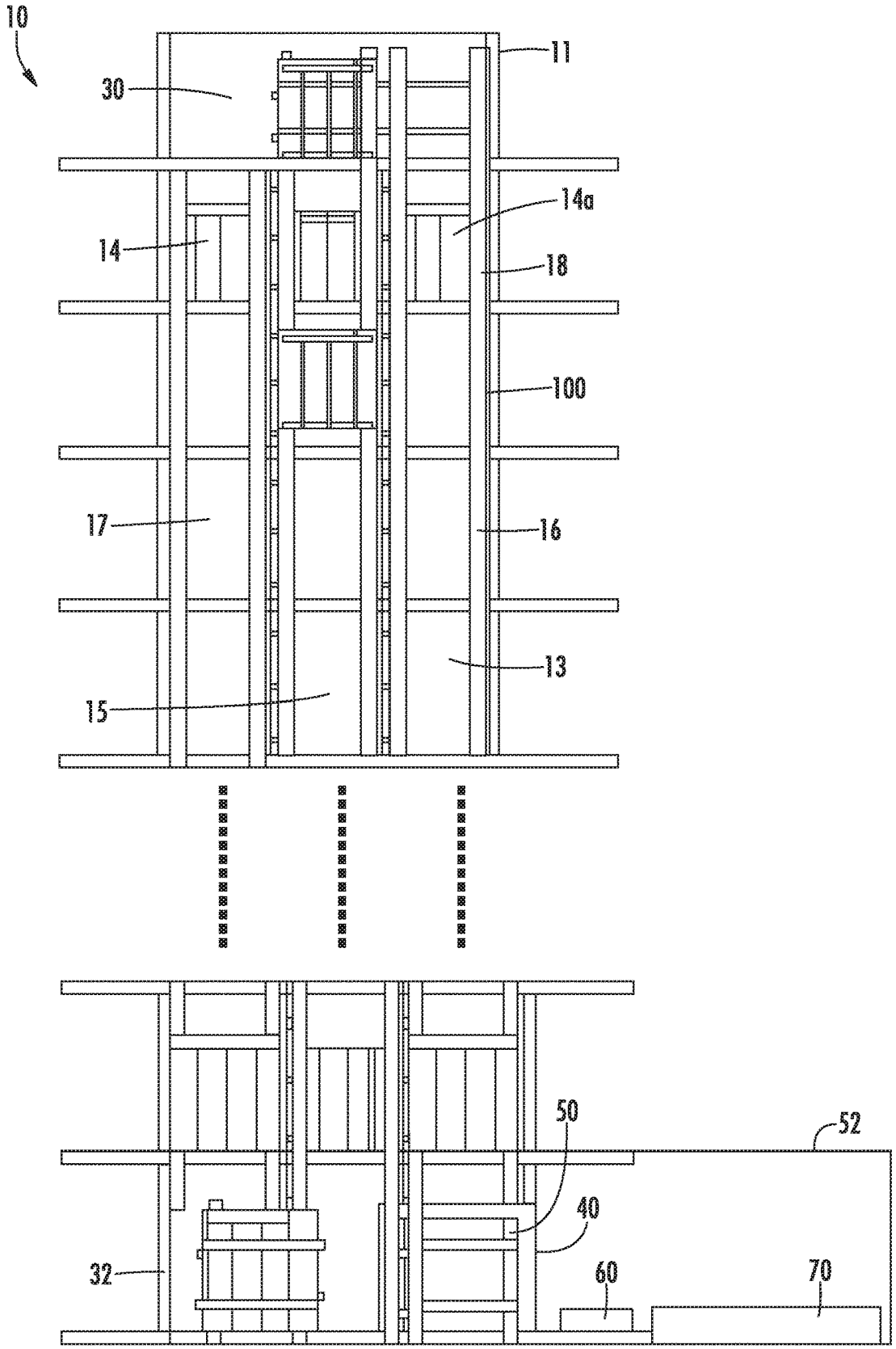
FIG. 1 depicts a multicar elevator system in an exemplary embodiment.

FIG. 1 depicts a multicar, ropeless elevator system 10 in an exemplary embodiment. Elevator system 10 includes a hoistway 11 having a plurality of lanes 13, 15 and 17. In certain embodiments, elevator system 10 includes modular components that can be associated to form an elevator system. Modular components include, but are not limited to a landing floor hoistway, a shuttle floor hoistway, a transfer station, a carriage, a parking area, a disengaging mechanism, etc. While three lanes are shown in FIG. 1, it is understood that embodiments may be used with multicar, ropeless elevator systems have any number of lanes. In each lane 13, 15, 17, cars 14 travel in mostly in one direction, i.e., up or down. For example, in FIG. 1 cars 14 in lanes 13 and 15 travel up and cars 14 in lane 17 travel down. One or more cars 14 may travel in a single lane 13, 15, and 17. In certain embodiments, cars 14 can move bi-directionally within lanes 13, 15, 17. In certain embodiments, lanes 13, 15, 17 can support shuttle functionality during certain times of the day, such as peak hours, allowing unidirectional, selective stopping, or switchable directionality as required. In certain embodiments, lanes 13, 15, 17 can include localized directionality, wherein certain areas of lanes 13, 15, 17 and hoistway 11 are assigned to various functions and building portions. In certain embodiments, cars 14 can circulate in a limited area of hoistway 11. In certain embodiments, cars 14 can operate at a reduced velocity to reduce operating and equipment costs. In other embodiments, hoistways 11 and lanes 13, 15, 17 can operate in a mixed mode operation wherein portions of hoistway 11 and lanes 13, 15, 17 operate normally (unidirectional or bidirectional) and other portions operate in another manner, including but not limited to, unidirectional, bidirectional, or in a parking mode. In certain embodiments, parked cars 14*a* can be parked in lanes 13, 15, 17 when lanes are designated for parking.

Above the top floor is an upper transfer station 30 to impart horizontal motion to elevator cars 14 to move elevator cars 14 between lanes 13, 15 and 17. In an exemplary embodiment, upper transfer station 30 and lower transfer station 32 in addition to other transfer stations and loading stations 50 can be disposed at any suitable location. It is understood that upper transfer station 30 may be located at the top floor, rather than above the top floor. Below the first floor is a lower transfer station 32 to impart horizontal motion to elevator cars 14 to move elevator cars 14 between lanes 13, 15 and 17. It is understood that lower transfer station 32 may be located at the first floor, rather than below the first floor. Although not shown in FIG. 1, one or more intermediate transfer stations may be used between the first floor and the top floor. Intermediate transfer stations are similar to the upper transfer station 30 and lower transfer station 32. Cars 14 are propelled using, for example, a linear motor system having a primary, fixed portion 16 and a secondary, moving portion 18. One or more fixed portions 16 are mounted in lanes 13, 15 and 17. One or more moving portions 18 are mounted on cars 14. One of the motor portions is supplied with drive signals to control movement of cars 14 in their respective lanes. In certain embodiments, lanes of hoistway 11 can be shut down or restricted based on operator input or elevator system conditions.

In an exemplary embodiment, elevator system 10 includes a loading station 50 to transfer cars 14 in and out of hoistway 11. In certain embodiments, the status and health of individual cars 14 are evaluated in an evaluation or health check station 40. In an exemplary embodiment, cars 14 are be introduced, removed, or serviced in an out of service area 52 by using transport mechanisms 60 in storage floor 70. In certain embodiments, a supervisory controller 100 can provide determinations or an interface regarding the introduction, removal and management of cars 14. Supervisory controller 100 may be utilized to determine the frequency and parameters of car 14 health checks. Further, supervisory controller 100 may provide control or an interface to determine the management and storage of cars 14 in storage area 52.

In an exemplary embodiment, multiple cars 14 can be used, introduced, and removed from elevator system 10. Advantageously, various cars 14 can be utilized for various purposes, including, but not limited to, trash collection, deliveries, vending services, elevator service, building service, and/or general service. Specialized cars may have unique identifiers, may only be accessed by authorized personnel, and have task specific features. For example, a car 14 utilized for trash services may contain a washable storage surface and features to interface or be manipulated by a garbage truck. In another embodiment, a delivery car 14 may receive deliveries from a delivery service to be delivered by elevator system 10. In certain embodiments, cars 14 for delivery or cargo purposes can be designed with reduced mass (netted walls, no air conditioning, etc.) to increase duty load. Further, cars 14 for delivery or cargo purposes may have special strapping points to secure a load, larger brakes. Certain cars 14 may move slower to increase load capacity. In certain embodiments, specialized cars 14 include blowers directed to linear motor primaries to cool linear motor primaries under heavy loads. In certain embodiments, cars 14 have customized interiors. For example, a visitor car 14 can include speakers, audio/visual components, and interactive features, etc. Further, cars 14 can easily be introduced and removed from elevator system 10 removing the need for a dedicated service hoistway 11. In certain embodiments, programmed or determined demand can determine the type of cars 14 introduced or removed from elevator system 10. In certain embodiments, conventional passenger cars 14 can circulate in elevator system 10 while special purpose cars described above can also simultaneously circulate without any interruption in service. Supervisory controller 100 may further control when specialty cars are introduced, utilized, and stored. In certain embodiments a regular car 14 is assigned special status or permissions to act as a special car for a period of time or when interacting with an authorized personnel. For example, emergency personnel such as firefighters, paramedics, police, security, etc. may be able to control other cars 14, cancel other car calls, give high priority to specific cars, clear a lane of hoistway 11, etc.

Figure 1A:
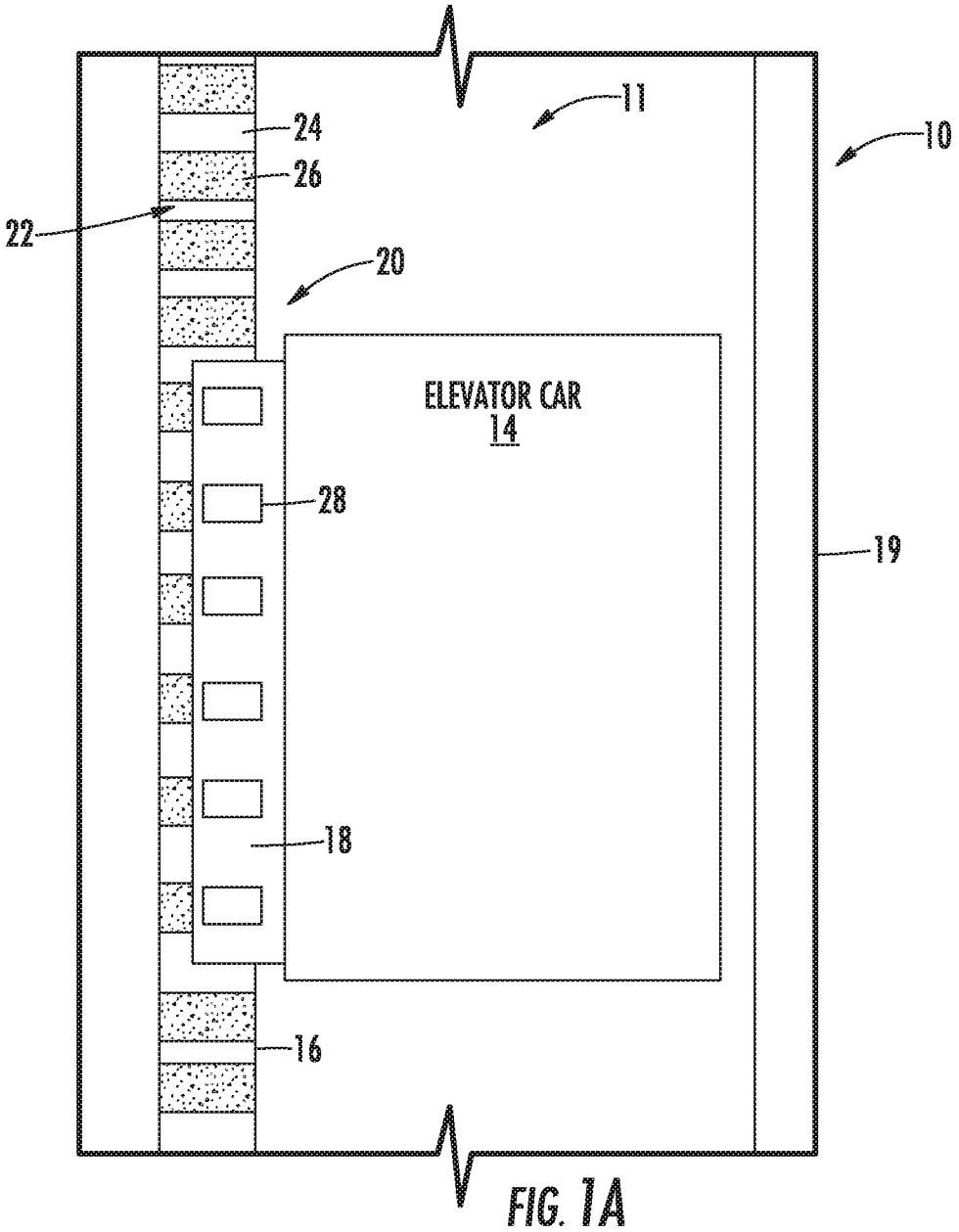
FIG. 1A depicts another view of a multicar elevator system.

Referring to FIG. 1A, illustrated is another view of the elevator system 10 including an elevator car 14 that travels in hoistway 11. Elevator car 14 is guided by one or more guide structure 24 extending along the length of hoistway 11, where the guide structure 24 may be affixed to hoistway wall, propulsion device, carriage structural member 19, or stacked over each other. For ease of illustration, the view of FIG. 1A only depicts a single side guide structure 24; however, there may be two or more guide structure 24 positioned, for example, on opposite sides of the elevator car 14. Elevator system 10 employs a vertical propulsion system 20, where same placement variations apply to vertical propulsion stationary portion 16 placed in the hoistway. Vertical propulsion stationary portion 16 includes multiple segments 22. Segments 22 may be affixed to hoistway wall, guide structure, carriage structural member 19, or stacked over each other. Propulsion moving portion 18 may be affixed to a car frame or be a structural member of a car frame. A number of propulsion moving portions 19 may be placed on a car.

Figure 2:
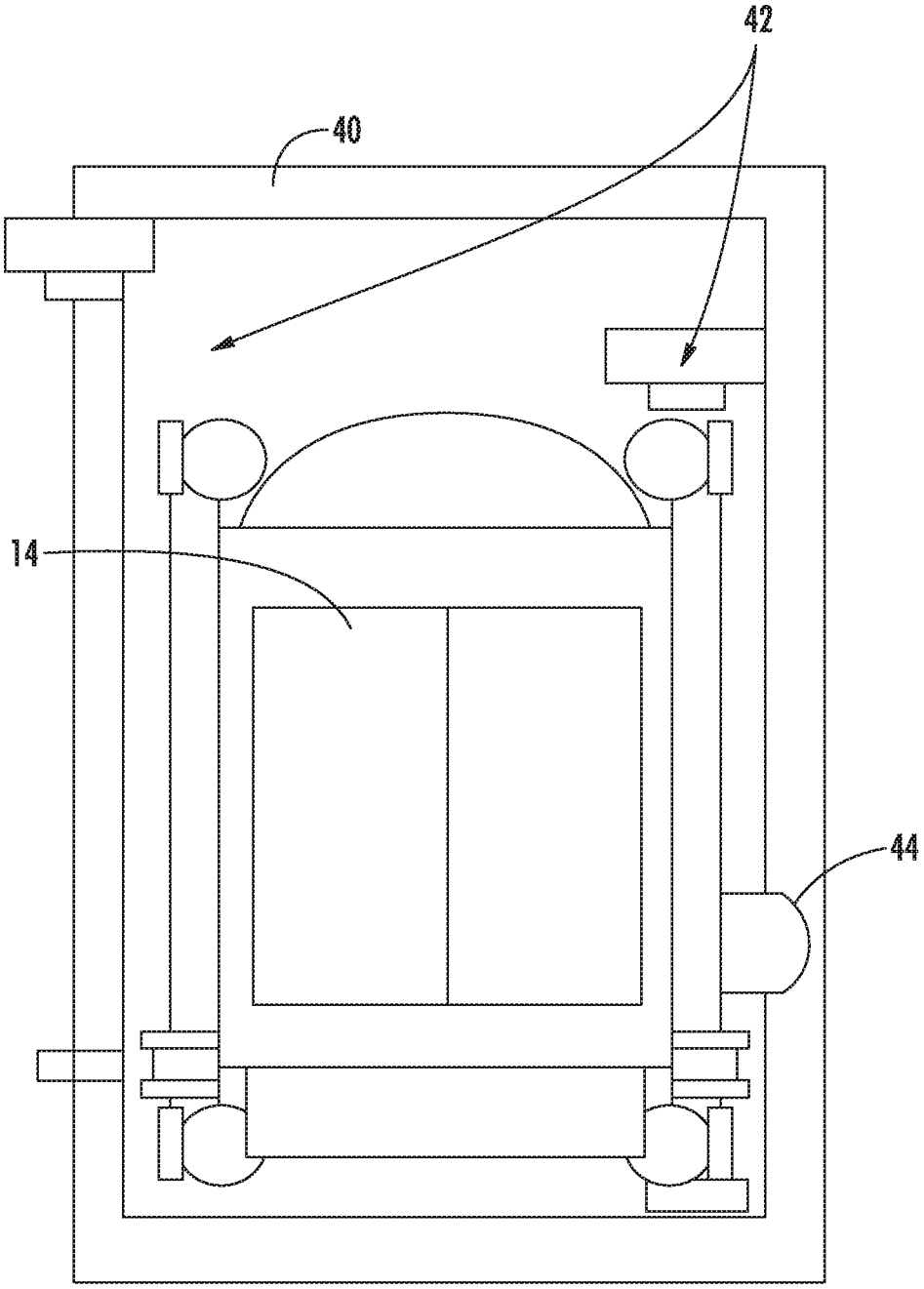
FIG. 2 shows an evaluation station for use in a multicar elevator system, such as the system depicted in FIG. 1.

Referring to FIG. 2 an exemplary embodiment of evaluation station 40 of system 10 is shown. In an exemplary embodiment, evaluation station (health check station) 40 is utilized to evaluate the status and health of cars 14 used within elevator system 10. In certain embodiments, health check station 40 is self contained within cars 14. Self contained health check components or stations 40 can be an on board health unit 40. Health check components 40 may send or transmit information regarding health or status of cars 14. Transmissions may be wireless and may include standardized wireless transmissions such as wi-fi transmissions. In certain embodiments, a "quick" data transfer can provide pertinent information regarding the status of car 14. In certain embodiments, evaluation station 40 can determine if a car 14 should be removed for service or maintenance. In certain embodiments, cars 14 can utilize an onboard evaluation station 40 to transmit determinations or flags after detecting errors to be removed from hoistway 11. In other embodiments, cars 14 are flagged by technical/maintenance personnel either remotely or directly from car 14. In an exemplary embodiment, evaluation stations 40 can evaluate car 14 status and health within the hoistway 11 without excessive downtime of car 14 or system 10. Advantageously, status and health checks can be performed quickly to not remove cars 14 from service for an excessive period of time. In certain embodiments, evaluations may be performed every time cars 14 pass therethough, on a periodic schedule, or during periods of low demand.

In certain embodiments, an evaluation station 40 checks and evaluates all cars 14 utilized in an elevator system 10. In other embodiments, evaluation station 40 is utilized and associated with a subset of cars 14 depending on parameters monitored.

In an exemplary embodiment, when a car 14 is evaluated by evaluation station 40, the car 14 is checked for proper calibration. In certain embodiments, measurements and feedback is recorded and monitored from on board sensors of car 14. In certain embodiments, data communication between car 14 and evaluation station 40 is performed. If evaluation station 40 determines the condition of a monitored car 14 is not satisfactory, the evaluation station 40 can signal to the loading station 50 to remove the car from the hoistway 11 for further service.

In certain embodiments, evaluation station 40 includes thrust monitors 42. Thrust monitors 42 may be utilized to evaluate the performance, condition, and readiness of the linear motors utilized by car 14 to propel the cars 14 through the hoistway 11. Accordingly, thrust monitors 42 can measure thrust capabilities of car 14 compared to ideal or minimum parameters. If thrust performance is not satisfactory, the evaluation station 40 may signal to the loading station 50 to remove car 14 from service. In certain embodiments, information about the health and status of cars 14 can be transmitted back to a central controller. In certain embodiments, health and status thresholds may be determined or input from a central controller. In certain embodiments, thrust monitors 42 are software or embedded monitors integrated with cars 14. Integrated thrust monitors 42 can provide feedback that may be reported back to a central controller to provide diagnostic information. In certain embodiments, thrust monitors 42 can also provide brake health verification. Similarly, brake monitoring functionality can be integrated into car 14 electronics. In certain embodiments, an integrated brake health monitor 42 can signal evaluation station 40 to perform an inspection or flag an inspection to be completed.

In certain embodiments, evaluation station 40 includes electrical/power monitors 44. Electrical monitors and power monitors 44 can communicate and monitor on board power systems of cars 14. Further, power monitors 44 can monitor state of charge of on board batteries of car 14. Similarly, if electrical conditions or battery state of charge of car 14 is unsatisfactory, evaluation station 40 can signal to loading station 50 to remove car 14.

Figure 3:
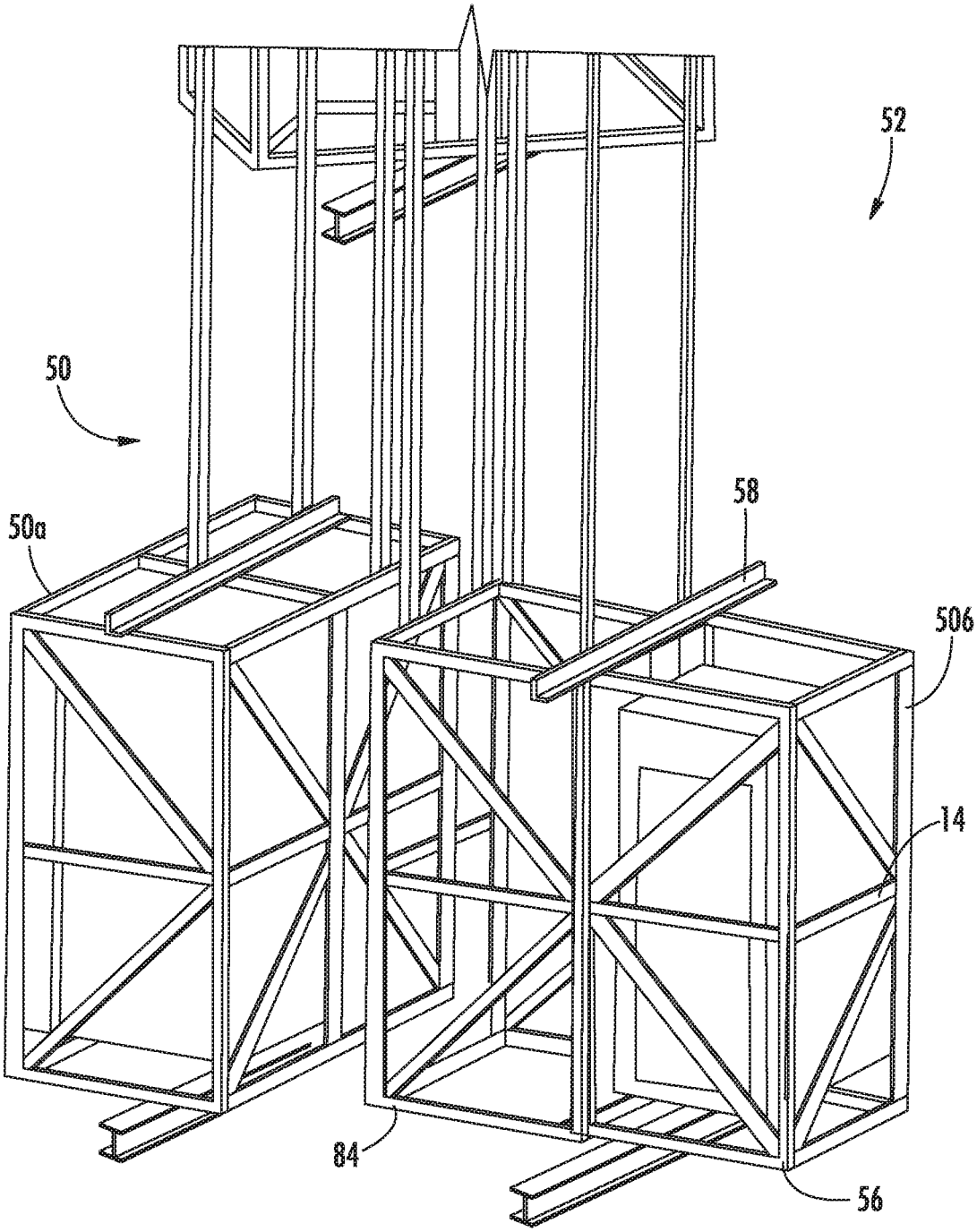
FIG. 3 shows a loading station for use in a multicar elevator system, such as the system depicted in FIG. 1.

Referring to FIG. 3, loading station 50 is utilized within system 10 to introduce and remove cars 14 from hoistway 11. Loading station 50 may be disposed in any suitable location. In certain embodiments, loading station 50 functionality can be performed by any suitable device, including cars 14 capable of introducing and removing themselves. In certain embodiments, elevator system 10 may include multiple loading stations 50 to add and remove cars 14 at multiple locations within a hoistway 11. In certain embodiments, loading station 50 can work in conjunction with transfer stations 30 or 32 to provide transfer functionality and remove and introduce cars 14 from hoistway 11.

In an exemplary embodiment, loading station 50 introduces cars 14 stored in a storage location 52 into the hoistway 11. Similarly, loading station 50 can remove cars 14 from the hoistway 11 to the storage location 52. Cars 14 may be introduced and removed to meet demand, satisfy maintenance requirements, for emergency repairs, as well as facilitate the use and removal of specialized cars. In an exemplary embodiment, cars 14 are evaluated via evaluation station 40, wherein determinations by evaluation station 40 may be used to determine if cars 14 are introduced, or removed from hoistway 11. Such determinations may be received from a centralized controller contained within the elevator system.

In an exemplary embodiment, loading station 50 allows for safe engaging and disengaging of cars 14 between an active elevator system and a storage area. During operation if a car 14 is to be removed, car 14 will enter the hoistway interface 54. In an exemplary embodiment, cars 14 can pass through hoistway interface 54 of loading station 50 without any change in performance and speed. Advantageously, lane continuity within hoistway 11 is maintained, requiring less or no alternative bypass paths or loops for car 14 travel. After a car 14 placed in loading station 50 is to be removed, the loading station 50 allows car 14 to exit via storage interface 56. During operation, loading station 50 may rotate hoistway interface 54 and service interface 56 may alternate and are referred to interchangeably based on relative location. In certain embodiments, multiple loading stations 50*a*, 50*b* are utilized to transfer cars 14 across greater lengths, such as larger hoist ways. In certain embodiments, alternative designs and methods are utilized for use with or as loading station 50.

Figure 4:
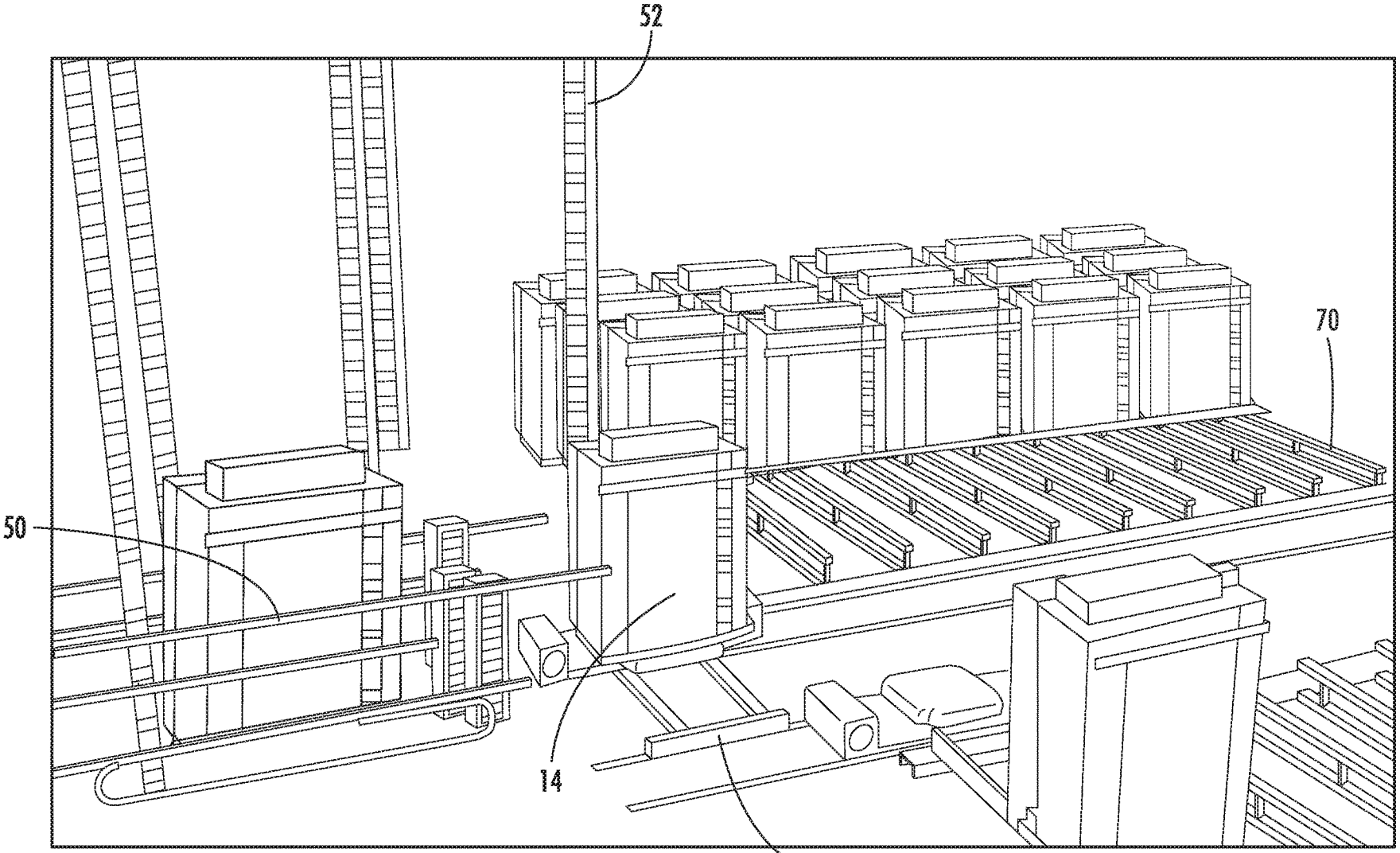
FIG. 4 shows an transport mechanism and parking area for use in a multicar elevator system, such as the system depicted in FIG. 1.

Referring to FIG. 4, the parking or storage area 52 is shown. In an exemplary embodiment, cars 14 that are to be stored, maintained or repaired are stored in storage area 52. In certain embodiments, storage area 52 is any suitable area, including areas of hoistway 11 not currently utilized, as shown in FIG. 1 as car 14*a*. In certain embodiments, when cars 14 are in storage areas 52, cars 14 can be held for regular or extended diagnostics in conjunction with a health station 40. Cars 14 may be stored and maintained in certain positions that allow for increased accessibility for maintenance and repair. Cars 14 are delivered and retrieved from storage area 52 via loading station 50. In an exemplary embodiment, cars 14 are received and delivered to loading station 50 on parking or transport mechanisms 60. In an exemplary embodiment, transport mechanisms 60 can include, but are not limited to, pallets, rollers, hangers, etc. In certain embodiments, pallets can include self propelled pallets, rail guided pallets, pallets with primary "dummies" to interface with cars 14, pallets without primary "dummies", etc. Advantageously, by placing cars 14 on parking mechanism 60, cars 14 are not required to have any special features to allow cars 14 to be moved or manipulated in storage area 52. Use of transport mechanisms 60 may allow additional car functions such as removing refuse, etc. Transport mechanisms 60 also facilitate the use of forklifts to move cars 14. Transport mechanisms 60 may be used in conjunction with storage floor 70.

Figure 5:
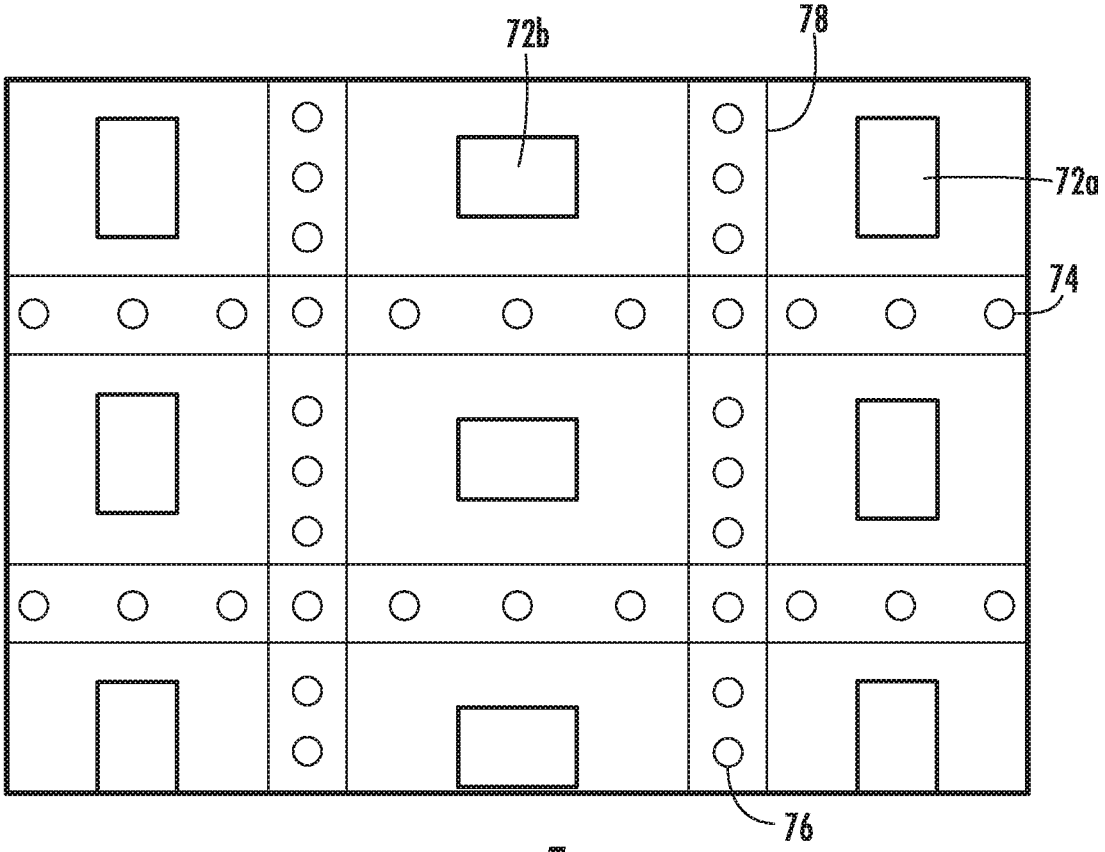
FIG. 5 shows a parking area for use in a multicar elevator system, such as the system depicted in FIG. 1.

Referring to FIG. 5, a storage floor 70 is utilized for use in storage area 52 to manage and store cars 14. In certain embodiments, cars 14 cannot move under their own power outside of hoistway 11, storage floor 70 allows for cars 14 to be manipulated. In other embodiments, cars 14 can be propelled or moved when parked or stored by mechanisms integrated into car 14. In an exemplary embodiment, storage floor 70 allows two dimensional movement of cars 14. In other embodiments, greater degrees of freedom and movement are enabled, including 3 degrees of freedom, or up to 6 degrees of freedom. Advantageously, cars 14 can be stored in any order and retrieved in any order to allow access and ease of dispatch. In an exemplary embodiment, storage floor 70 is located in a storage area 52. In other embodiments, storage floor 70 is located within hoistway 11. In other embodiments, storage floor 70 is located in any suitable location. In certain embodiments, storage floor 70 includes multiple lanes or zones for storage and transportation. Storage floor 70 may be configured in any suitable layout. Storage floor 70 may include various modes of operation including but not limited to loading, unloading, first in first out, last in first out, etc. In a certain embodiment, storage floor 70 is a one dimensional mechanism that facilitates last in first out functionality. In certain embodiments, storage floor 70 is a two dimensional mechanism that allows cars 14 to move in x and y directions. In other embodiments, storage floor 70 is a three dimensional mechanism that allows cars 14 to be moved and stored in x, y, and z directions. In certain embodiments, a storage floor 70 mechanism can also allow for cars to be moved and stored with manipulations of pitch, yaw, and roll.

In an exemplary embodiment, rollers 72*a*, 72*b*, 74, and 76 are utilized to move cars 14 about floor 70. In other embodiments, any suitable method is utilized to move cars 14 on floor 70. In an exemplary embodiment, rollers 72*a*, 72*b*, 74, and 76 are computerized rollers synchronized and coordinated to move cars 14 in a desired manner. Cars 14 may be stored on transport mechanism 60 for a unified rolling surface. Rollers 72*a* and 72*b* may be directional rollers to move the cars 14, while rollers 74 and 76 may be rolling ball type rollers to allow fine control over the position of cars 14. In certain embodiments, certain rollers 72*a*, 72*b*, 74, 76 are disposed in channels 78 to interface with features of cars 14 or transport mechanisms 60. In certain embodiments, any suitable robotic or automated rollers integrated into a floor 70 can be used. Advantageously, the use of rollers allows cars 14 to be stored in any desired order and retrieved in any desired manner. In certain embodiments, storage floor 70 is controlled by a centralized controller to determine the locations and retrieval of cars 14.

The terminology used herein is for the purpose of describing particular embodiments only and is not intended to be limiting of the invention. While the description of the present invention has been presented for purposes of illustration and description, it is not intended to be exhaustive or limited to the invention in the form disclosed. Many modifications, variations, alterations, substitutions or equivalent arrangement not hereto described will be apparent to those of ordinary skill in the art without departing from the scope and spirit of the invention. Additionally, while the various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. An elevator system comprising:

a plurality of elevator cars to travel in a hoistway, the plurality of elevator cars propelled by a motor;

a loading station to selectively introduce and remove at least one of the plurality of elevator cars to and from the hoistway; and an evaluation station configured to evaluate at least one of the plurality of elevator cars;

wherein the evaluation station evaluates at least one of a thrust performance of the motor and a power performance of an on-car power system of the at least one of the plurality of elevator cars when positioned in the evaluation station to determine a condition of the at least one of the plurality of elevator cars;

the evaluation station signaling the loading station to remove the at least one of the plurality of elevator cars from the hoistway in response to the condition of at least one of the plurality of elevator cars.

2. The elevator system of claim 1, wherein an elevator car of the plurality of elevator cars is a specialized elevator car.

3. The elevator system of claim 2, wherein the specialized elevator car includes at least one of a vending car, a delivery car, a cargo car, a trash car, a private VIP car, a visitor car and a service car.

4. The elevator system of claim 2, wherein the specialized elevator car is assigned a higher priority than a remainder of the plurality of elevator cars.

5. The elevator system of claim 1, wherein an elevator car of the plurality of elevator cars includes an on board evaluation station in the elevator car.

6. The elevator system of claim 1, wherein an elevator car of the plurality of elevator cars includes a wireless link to communicate a car status to the elevator system.

7. The elevator system of claim 1, wherein the evaluation station evaluates at least one of the plurality of elevator cars periodically.

8. The elevator system of claim 1, further comprising a transportation device to receive and transport a removed elevator car of the plurality of elevator cars.

9. The elevator system of claim 1, further comprising a transport mechanism to transport and store a removed elevator car of the plurality of elevator cars.

10. The elevator system of claim 1, wherein an elevator car is stored in the hoistway without obstructing a hoistway lane.

11. The elevator system of claim 1, wherein a removed elevator car is stored in a last in first out transport mechanism, a first in first out transport mechanism, or a selective transport mechanism.

12. A method managing an elevator system, comprising:

providing a plurality of elevator cars to travel in a hoistway, the plurality of elevator cars propelled by a motor;

selectively introducing and removing at least one of the plurality of elevator cars to and from the hoistway via a loading station;

moving at least one of the plurality of elevator cars to an evaluation station;

at the evaluation station, evaluating at least one of a thrust performance of the motor and a power performance of an on-car power system of the at least one of the plurality of elevator cars when positioned in the evaluation station to determine a condition of the at least one of the plurality of elevator cars;

the evaluation station signaling the loading station to remove the at least one of the plurality of elevator cars from the hoistway in response to the condition of at least one of the plurality of elevator cars.

13. The method of claim 12, wherein an elevator car of the plurality of elevator cars is a specialized elevator car.

14. The method of claim 12, further comprising receiving and transporting a removed elevator car of the plurality of elevator cars via a transportation device.

15. The method of claim 12, further comprising transporting and storing a removed elevator car of the plurality of elevator cars via a transport mechanism.

16. An elevator system comprising:

a plurality of elevator cars to travel in a hoistway, the plurality of elevator cars propelled by a motor; and a loading station to selectively introduce and remove at least one of the plurality of elevator cars to and from the hoistway;

an evaluation station configured to evaluate at least one of the plurality of elevator cars;

wherein the evaluation station evaluates a power performance of an on-car power system of the at least one of the plurality of elevator cars when positioned in the evaluation station to determine a condition of the at least one of the plurality of elevator cars;

the evaluation station signaling the loading station to remove the at least one of the plurality of elevator cars from the hoistway in response to the condition of at least one of the plurality of elevator cars.

* * * * *